US008342540B1

(12) United States Patent
Marleau

(10) Patent No.: US 8,342,540 B1
(45) Date of Patent: Jan. 1, 2013

(54) VEHICLE IMPLEMENT AND SUSPENSION LIMITER

(75) Inventor: Benoit Marleau, St-Hyacinthe (CA)

(73) Assignee: Bombardier Recreational Products Inc., Valcourt (CA)

( * ) Notice: Subject to any disclaimer, the term of this patent is extended or adjusted under 35 U.S.C. 154(b) by 90 days.

(21) Appl. No.: 13/077,342

(22) Filed: Mar. 31, 2011

(51) Int. Cl.
*B60G 17/005* (2006.01)

(52) U.S. Cl. ..... 280/5.513; 280/124.134; 280/124.137

(58) Field of Classification Search ..... 280/124.125, 280/124.134, 124.135, 124.137, 124.152, 280/754, 755, 5.513, 6.159, 495–498; 37/231, 37/235
See application file for complete search history.

(56) References Cited

U.S. PATENT DOCUMENTS

| | | | | |
|---|---|---|---|---|
| 3,800,447 | A | 4/1974 | Harvey | |
| 5,707,072 | A | 1/1998 | Hopper | |
| 5,746,275 | A * | 5/1998 | Cross et al. | 172/440 |
| 6,732,811 | B1 * | 5/2004 | Elliott | 172/445.1 |
| 6,752,403 | B2 * | 6/2004 | Allen et al. | 280/6.157 |
| 6,931,770 | B2 | 8/2005 | Belzile | |
| 7,063,169 | B2 * | 6/2006 | Elliott | 172/445.1 |
| 7,429,003 | B2 * | 9/2008 | Thompson et al. | 239/167 |
| 7,631,817 | B2 * | 12/2009 | Thompson et al. | 239/159 |
| 7,766,094 | B2 * | 8/2010 | Hubscher et al. | 172/272 |
| 2011/0027009 | A1 | 2/2011 | Kusiak et al. | |

OTHER PUBLICATIONS

DirtWorks ATV Suspension Lock; Retrieved from <http://www.buy.com/prod/dirtworks-atv-suspension-lock/q/loc/66357/204291824.html> retrieved on Apr. 13, 2011.

Kolpin® DirtWorks™ ATV Suspension Lock; Retrieved from <http://www.cabelas.com/mowers-implements-kolpin-dirtworks-8482-atv-suspension-lock-2.shtml>; close up of image at <http://www.cabelas.com/catalog/largeImagePopup.jsp?productId=746931> retrieved on Apr. 20, 2011.

* cited by examiner

*Primary Examiner* — Drew Brown
(74) *Attorney, Agent, or Firm* — BCF LLP

(57) ABSTRACT

A motorized vehicle includes left and right suspensions connected to a frame. The left and right suspensions are moving in predetermined directions. A vehicle implement is pivotally connected to one of a front portion and a rear portion of the frame by at least one arm. The vehicle implement is pivotable between a first position and a second position. The second position is vertically higher than the first position. At least one suspension limiter is operatively connected to the at least one arm. When the vehicle implement is in the first and second positions, the left and right suspensions are free to move in the predetermined directions. When the vehicle implement is in a position intermediate the first and second positions, the at least one suspension limiter restricts movement of the left and right suspensions in at least one of the predetermined directions. A suspension limiter is also provided.

20 Claims, 11 Drawing Sheets

VEHICLE IMPLEMENT AND SUSPENSION LIMITER

TECHNICAL FIELD

The present invention relates to vehicle implements and suspension limiters for motorized vehicles.

BACKGROUND

Some all-terrain vehicles (ATVs) feature removable vehicle implements. One popular vehicle implement is a plow. The plow is typically fixed to the front of the ATV for the duration of the winter months. In some vehicles, the plow is attached to the front of the frame of the ATV. In others, the plow is attached to a middle portion of the frame rearwardly of the front wheels.

When the plow is attached to the front of the frame, a weight of the vehicle is transferred forward when the plow is lifted off the ground. On the other hand, when the plow is attached to the middle portion of the frame, the above is less of an issue but the ground clearance of the vehicle is reduced because of the plow attachment, compared to when the plow is attached to the front of the frame. To benefit from a better weight distribution and an acceptable ground clearance at the same time, some ATVs have the plow connected to the front of the vehicle and disposed relatively close to the vehicle. While this arrangement somewhat solves the above issues, the distance between the plow and the ATV reduces the maneuverability of the plow (e.g. rotation about a vertical pivot axis).

In addition, when the vehicle is set in motion with the plow lifted off the ground, the weight of the plow may create a moment that may reduce the maneuverability of the vehicle. Such situation is not desired.

Therefore, there is a need for a vehicle with a vehicle implement that would provide a good weight distribution and an acceptable ground clearance when the vehicle implement is lifted off the ground, while retaining maneuverability of the plow.

SUMMARY

It is an object of the present invention to ameliorate at least some of the inconveniences present in the prior art.

It is also an object of the present invention to provide a vehicle with a vehicle implement and a suspension limiter.

It is also an object of the present invention to provide a suspension limiter for a motorized vehicle.

In one aspect, a motorized vehicle is provided. The motorized vehicle comprises a frame. An engine is supported by the frame. Left and right ground engaging members are operatively connected to the frame. Left and right suspensions are connected to the frame. The left suspension is operatively connected to the left ground engaging member. The right suspension is operatively connected to the right ground engaging member. When in operation, the left and right suspensions are moving in predetermined directions. A vehicle implement is pivotally connected to one of a front portion and a rear portion of the frame by at least one arm. The vehicle implement is pivotable between a first position and a second position. The second position is vertically higher than the first position. At least one suspension limiter is operatively connected to the at least one arm. When the vehicle implement is in the first and second positions, the left and right suspensions are free to move in the predetermined directions. When the vehicle implement is in a position intermediate the first and second positions, the at least one suspension limiter restricts movement of the left and right suspensions in at least one of the predetermined directions.

In an additional aspect, when the vehicle implement is in a position intermediate the first and second positions, the left and right suspensions can move independently in at least one of the predetermined directions other than the at least one of the predetermined directions.

In a further aspect, the at least one suspension limiter includes a left suspension limiter and a right suspension limiter. When the vehicle implement is in a position intermediate the first and second positions, the left and right suspension limiters restrict movement of the left and right suspensions respectively in the at least one of the predetermined directions.

In an additional aspect, the at least one suspension limiter comprises at least one stopper connected to the vehicle implement. At least one engagement member connected to the left and right suspensions. The at least one engagement member is in selective abutment with the at least one stopper. When the vehicle implement is in the first and second positions, the at least one engagement member is spaced from the at least one stopper. When the vehicle implement is in the position intermediate the first and second positions, the at least one engagement member selectively abuts the at least one stopper. An abutment between the at least one stopper and the at least one engagement member is preventing the left and right suspensions to move in the at least one of the predetermined directions.

In a further aspect, the at least one stopper includes a curved plate.

In an additional aspect, the at least one suspension limiter further comprises at least one swivel arm rotatably connected to the left and right suspensions. The at least one swivel arm is rotatably connected to the frame. The at least one engagement member is fixedly connected to the at least one swivel arm.

In a further aspect, the at least one suspension limiter comprises at least one stopper connected to the vehicle implement. At least one engagement member is connected to the left and right suspensions. A left swivel arm is rotatably connected to the left suspension. A right swivel arm is rotatably connected to the right suspension. The at least one engagement member is in selective abutment with the at least one stopper. The left swivel arm and the right swivel arm are rotatably connected to the frame. The at least one engagement member includes a left engagement member and a right engagement member. The right engagement member is fixedly connected to the right swivel arm. The left engagement member is fixedly connected to the left swivel arm. When the vehicle implement is in the first and second positions, the left and right engagement members are spaced from the at least one stopper. When the vehicle implement is in the position intermediate the first and second positions, at least one of the right and left engagement members selectively abuts the at least one stopper. An abutment between the at least one stopper and the at least one of the left and right engagement members is preventing the left and right suspensions to move in the at least one of the predetermined directions. The left and right suspensions can move independently from one another in the at least one of the predetermined directions other than the at least one of the predetermined directions.

In an additional aspect, the at least one arm is pivotally connected to the frame by a bracket. The at least one swivel arm is rotatably connected to the bracket.

In an additional aspect, movement of at least one of the left and right suspensions induces a rotation of the at least one swivel arm and of the at least one engagement member.

In a further aspect, the at least one engagement member includes at least one fork. The at least one stopper is disposed on an end of the at least one arm distal from the vehicle implement.

In an additional aspect, the at least one arm includes two arm portions and a transverse rod extending between the two arm portions. The at least one stopper is defined by the transverse rod.

In a further aspect, the at least one stopper includes a curved plate. The vehicle implement is pivotable between the first and second positions about a horizontal axis. The horizontal axis extends longitudinally through the transverse rod. The horizontal axis passes through the curved plate.

In an additional aspect, the motorized vehicle is an all-terrain vehicle and the at least one ground engaging member is four wheels.

In a further aspect, a lock disposed on at least one of the at least one arm and the frame. The lock locks the at least one arm in the second position.

In an additional aspect, the at least one arm has a shape at least partially generally complementary with a portion of a corresponding one of a front portion and a rear portion of the vehicle.

In a further aspect, a lifting assembly for pivoting the vehicle implement between the first and second positions. The lifting assembly includes a winch disposed on the one of the front portion and the rear portion of the frame. A cable is wound on the winch. The cable is engaged with the at least one arm. The cable has a free end. A hook is connected to the free end of the cable. winding the cable around the winch causes the at least one arm to move toward the second position. When the at least one arm is locked in the second position, the cable can be wound and unwound around the winch and the at least one arm remains in the second position.

In an additional aspect, the at least one arm is removably connected to the vehicle implement. When in the first position, the at least one arm is in a position for connection with the vehicle implement.

In another aspect, a motorized vehicle is provided. The motorized vehicle comprises a frame. An engine is supported by the frame. Left and right ground engaging members are operatively connected to the frame. Left and right suspensions are connected to the frame. The left suspension is operatively connected to the left ground engaging member. The right suspension is operatively connected to the right ground engaging member. When in operation, the left and right suspensions are moving in predetermined directions. A vehicle implement is pivotally connected to one of a front portion and a rear portion of the frame by at least one arm. The vehicle implement is pivotable between a first position and a second position. The second position is vertically higher than the first position. At least one suspension limiter is operatively connected to the at least one arm. The at least one suspension limiter include at least one stopper connected to the vehicle implement. A right engagement member is connected to the right suspension. The right engagement member is in selective abutment with the at least one stopper. A left engagement member is connected to the left suspension. The left engagement member is in selective abutment with the at least one stopper. A left swivel arm is rotatably connected to the left suspension and to the frame. The left engagement member is fixedly connected to the left swivel arm. A right swivel arm is rotatably connected to the right suspension and to the frame. The right engagement member is fixedly connected to the right swivel arm. When the vehicle implement is in the first position, the left and right engagement members are spaced from the at least one stopper and the left and right suspensions are free to move in the predetermined directions. When the vehicle implement is in a position other than the first position, at least one of the right and left engagement members selectively abuts the at least one stopper, an abutment between the at least one stopper and the at least one of the left and right engagement members preventing the left and right suspensions to move in the at least one of the predetermined directions. The left and right suspensions can move independently from one another in the at least one of the predetermined directions other than the at least one of the predetermined directions.

In yet another aspect, a suspension limiter for a suspension assembly of a motorized vehicle is provided. The suspension assembly is movable in predetermined directions. The suspension limiter comprises at least one swivel arm adapted to be connected to the suspension assembly. At least one bearing is on the at least one swivel arm. The at least one bearing is adapted to be connected to a frame of the motorized vehicle. At least one stopper is adapted to be movably connected to the frame. At least one engagement member is fixedly connected to the at least one swivel arm. The at least one engagement member is selectively abutting the at least one stopper. An abutment between the at least one stopper and the at least one engagement member is preventing the suspension assembly to move in the at least one of the predetermined directions.

In a further aspect, at least one arm is adapted to be pivotally connected to the frame. The at least one arm includes the at least one stopper. When in operation, a rotation of the at least one arm selectively abuts the at least one engagement member to the at least one stopper.

For purposes of this application, terms related to spatial orientation such as forwardly, rearwardly, upwardly, downwardly, left, and right, are as they would normally be understood by a driver of the vehicle sitting thereon in a normal riding position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Although the present vehicle implement assembly is being described herein in combination with an all-terrain vehicle (ATV) 10, it is contemplated the present vehicle implement assembly could be used with other wheeled vehicles (e.g. three-wheeled vehicles or small pick-up trucks) or tracked vehicles.

Figure 1:
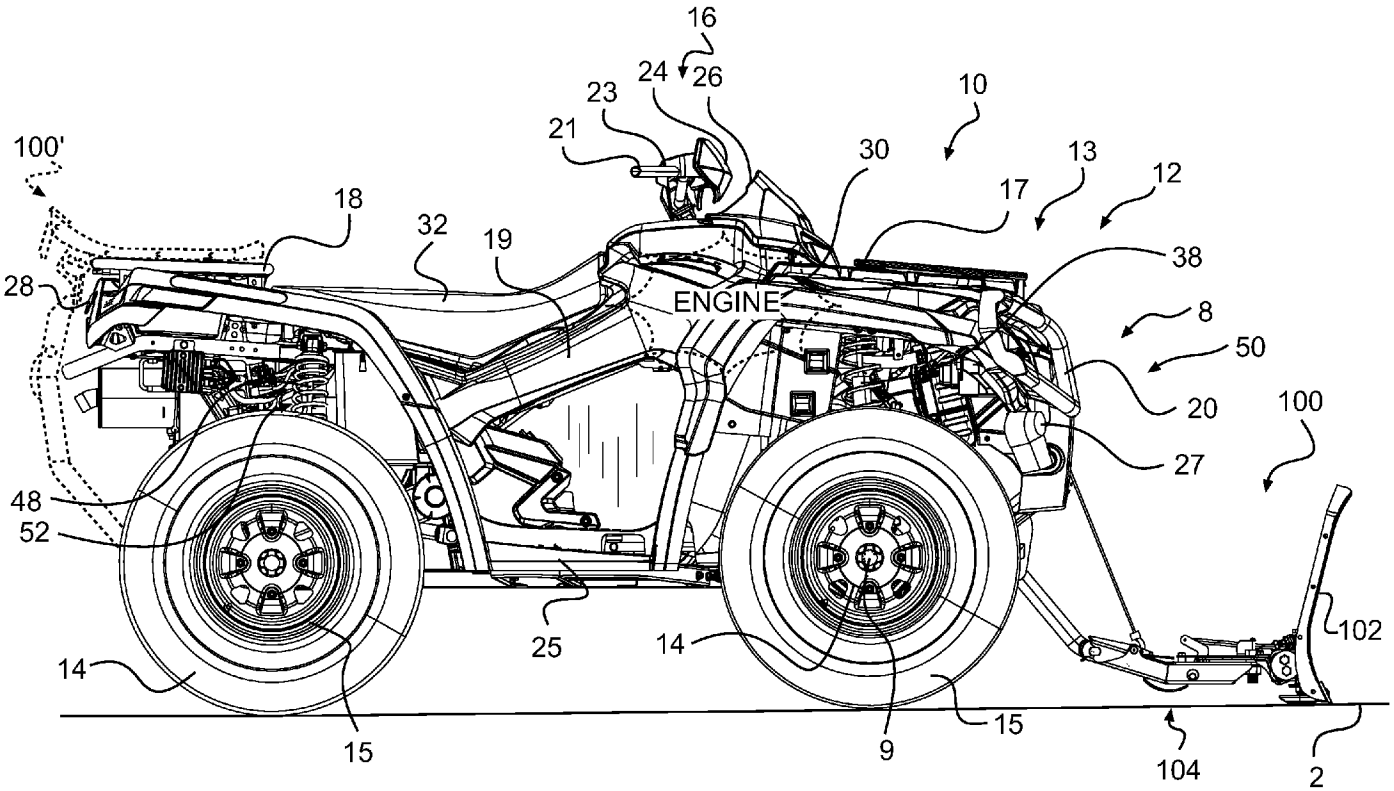
FIG. 1 is a right side elevation view of an all-terrain vehicle (ATV) having a front plow assembly shown in solid lines and with an optional and/or an alternative rear plow assembly shown in dotted lines.

Referring to FIG. 1, the ATV 10 operates on a ground 2. The ATV 10 includes a frame 12 to which is mounted a body 13 and an internal combustion engine 30 (shown in phantom) for powering the vehicle. The engine 30 is a 4-cycle, single overhead cam, in-line or V-type engine. It is contemplated that other types and configurations of engines could be used.

Figure 4:
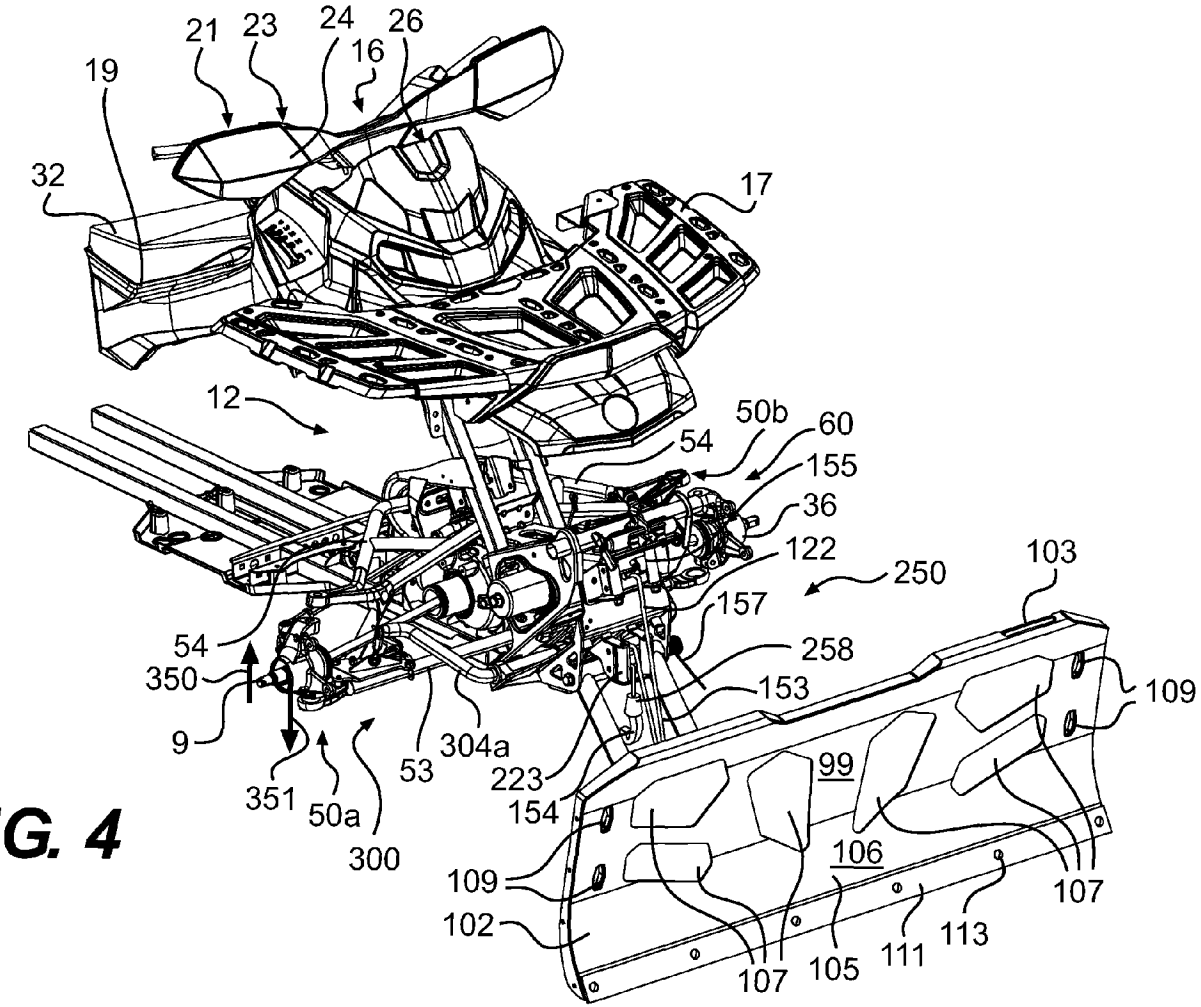
FIG. 4 is a perspective view taken from a top, front, right side of the forward end of the ATV of FIG. 1 with some elements removed for clarity, and with a second embodiment of the lifting assembly for the front plow assembly.

The body 13 includes a front platform 17, a rear platform 18 and a plurality of fairing panels 19 and bumpers 20. As best seen in FIG. 4, the front platform 17 has a plurality of apertures. The platform 17 is used to secure items thereonto. The ATV 10 further includes a straddle seat 32 mounted to the frame 12 for supporting a driver and optionally one or more passengers. Left and right foot rests 25 (only the right foot rest being shown) are attached to each side of the frame 12 and extend therefrom to receive a foot of the driver of the ATV 10. It is contemplated that the ATV 10 could have only the front platform 17 or only the rear platform 18, or that the front platform 17 and the rear platform 18 could be omitted. It is also contemplated that the ATV 10 could have more than one front platform 17 and/or rear platform 18. It is contemplated that the front platform 17 could not have the apertures recited above.

Also connected to the frame 12 are four wheels 14 (right and left front and right and left rear, only the front right and the rear right being shown). The front and rear wheels 14 have 10 to 12 inch rims and are each provided with a low-pressure balloon tire 15 that is mounted to a rim of each wheel 14 and inflated to a pressure of no more than 2 kg/cm$^2$ (i.e., no more than 196 kPa or 28 psi). The low-pressure balloon tires 15 are adapted for off-road conditions and traversing rugged terrain. The ATV 10 is four-wheel-drive (4WD). It is contemplated that the ATV 10 could be a two-wheel-drive (2WD), or permit selection between the 2WD and the 4WD.

The two front wheels 14 are suspended from the frame 12 by respective right and left front suspension assemblies 50*a*, 50*b*. The two rear wheels 14 are suspended from the frame 12 by respective right and left rear suspension assemblies 52 (right and left, only right being shown). As best seen in FIG. 4, each front suspension assembly 50*a*, 50*b* includes a lower A-arm 53 and an upper A-arm 54. The apexes of the lower and upper A-arms 53, 54 are operatively connected to their corresponding wheel 14 and the ends of the legs of the lower and upper A-arms 53, 54 are connected to wheel attachment portions (not shown) on the frame 12. Each front suspension assembly 50*a*, 50*b* includes a shock absorber 38 that is connected at one end to the lower A-arm 53 and to a corresponding bracket (not shown) on the frame 12 at the other end. The front suspension assemblies 50*a*, 50*b* move in predetermined directions. These predetermined directions correspond, for the embodiment of the front suspension assemblies 50*a*, 50*b* described herein, to general upward movement (illustrated by arrow 350) and general downward movement (illustrated by arrow 351) of the outer ends of the A-arms 53, 54. As will be described below, a suspension limiter 300 locks the front suspension assemblies 50*a*, 50*b* in the predetermined direction 350 when the snow plow 102 is lifted off the ground 2. The rear suspension assemblies 52 each include a swing arm (not shown) pivotally connected at one end to the frame 12. For each rear suspension assembly 52, a shock absorber 48 is connected between the frame 12 and the swing arm.

It should be understood that the suspension assemblies 50*a*, 50*b*, 52 described above are only exemplary and that other types and geometries of suspension assemblies could be used.

The ATV 10 further includes a steering mechanism 16 which is rotationally supported by the frame 12 to enable a driver to steer the vehicle. The steering mechanism 16 includes a handlebar 21 connected to a steering column 22 (shown in FIG. 5) for actuating steering linkages connected to left and right front wheels 14. A pair of rear view mirrors 24 is located forward of the handlebar 21. A display cluster 26 is located forward of the pair of rear mirrors 24. The ATV 10 includes other features which will not be described herein.

Figure 2:
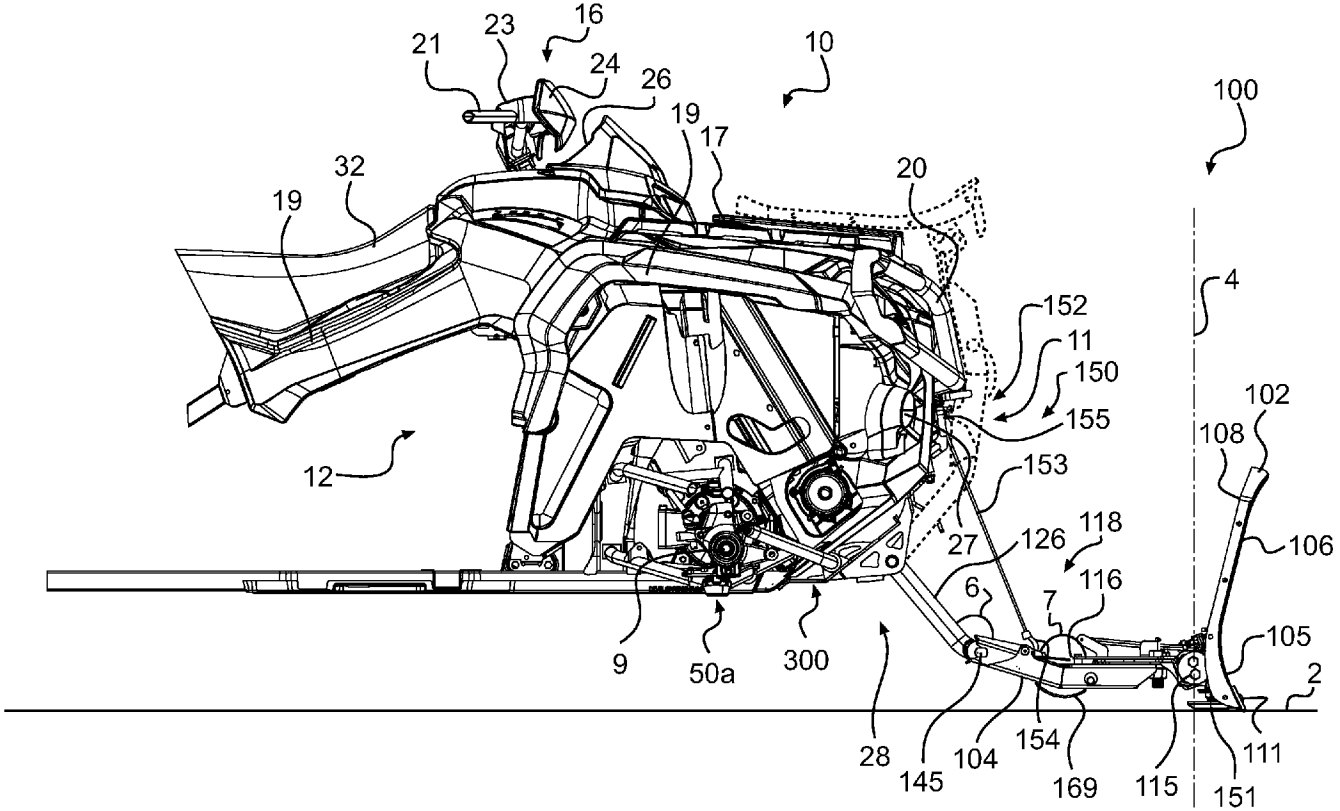
FIG. 2 is a right side elevation view of a forward end of the ATV of FIG. 1 shown with a first embodiment of a lifting assembly for the front plow assembly, with some elements removed for clarity and with a stowed position of the front plow assembly shown in dotted lines.

The ATV 10 has a detachable and stowable plow assembly 100 which is connected to a front portion 11 (shown in FIG. 2) of the frame 12 forward of drive axles 9 of the front wheels 14. It is contemplated that the plow assembly 100 could be fixed to the ATV 10. The ATV 10 could also have in addition to or instead of, a detachable plow assembly 100' connected at a rear portion of the frame 12 rearward of the drive axles 9 of the rear wheels 14. The plow assembly 100 and the plow assembly 100' being generally a mirror of each other with respect to a center of the ATV 10, only the plow assembly 100 will be described herein, except for some specific aspects of the plow assembly 100'. As best seen in FIG. 2, the plow assembly 100 is movable between a lowered position (shown in solid) where the plow assembly 100 is in operation for plowing, and a raised position (shown in phantom) where the plow assembly 100 is stowed. A button 23 located near the handlebar 21 controls a position of the plow assembly 100. A lifting assembly 150 or 250 operated by the user via the button 23 moves the plow assembly 100 between the lowered position and the raised position. The plow assembly 100 and the lifting assemblies 150, 250 will be described in greater detail below.

A pair of abutment studs 180 (shown in FIG. 7) and an abutment bumper 181 (shown in FIG. 7) are disposed on a front portion 8 of the ATV 10. As best seen in FIG. 11A, the abutment studs 180 and abutment bumper 181 abut a push frame 104 of the plow assembly 100 when the plow assembly 100 is in the raised position. The abutment studs 180 and the abutment bumper 181 are made of rubber to attenuate vibrations that may occur when the plow assembly 100 reaches the raised position. It is contemplated that the abutment studs 180 and the abutment bumper 181 could be made of soft plastic or foam. It is contemplated that the abutment studs 180 could be omitted or be replaced by abutment bumpers. It is also contemplated that the abutment studs 180 and/or the abutment bumper 181 could be located on the push frame 104. It is also contemplated that the ATV 10 could have more or less than a pair of abutment studs 180 and one abutment bumper 181 to attenuate vibrations when the push frame 104 contact the front portion 8 of the ATV 10.

Figure 3:
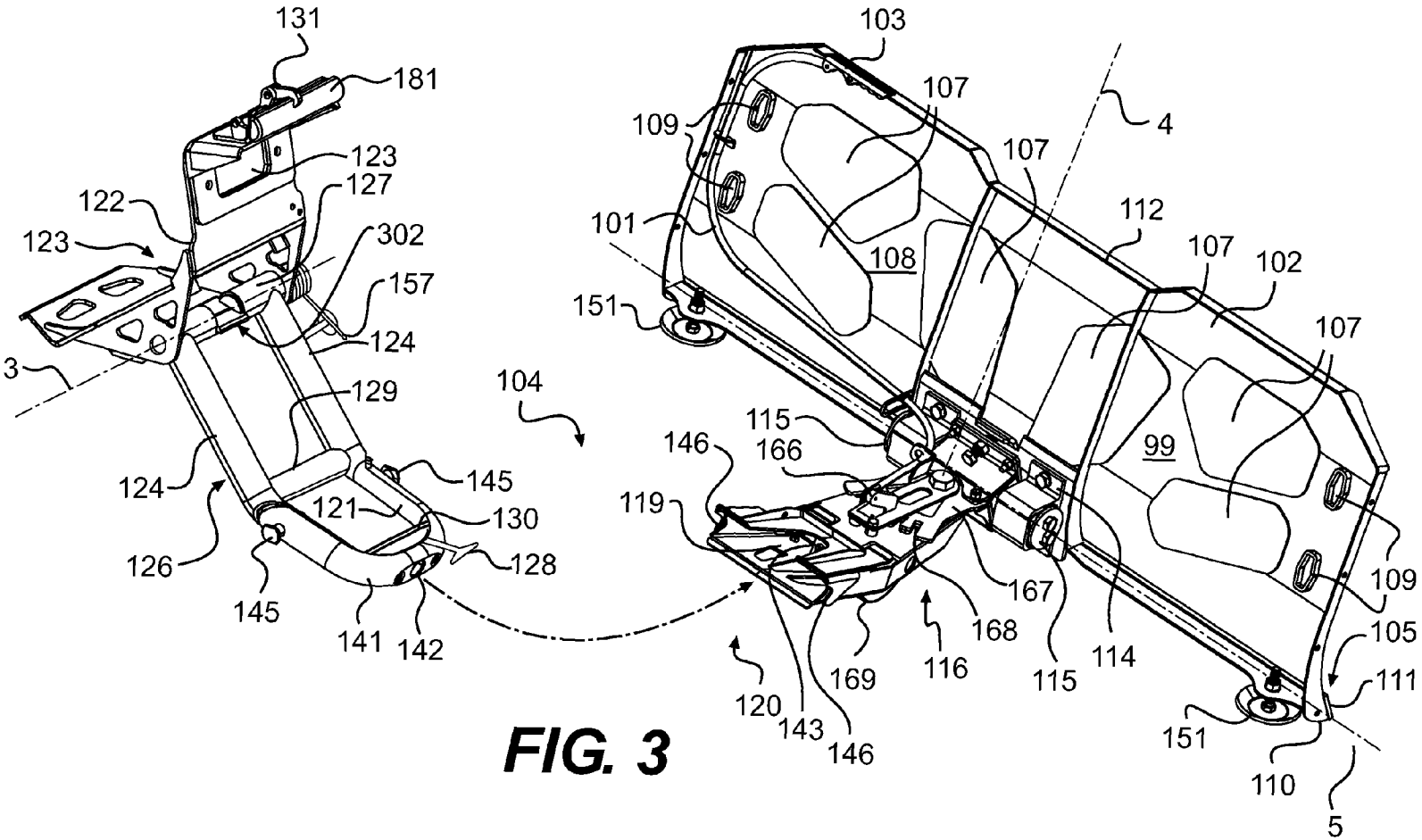
FIG. 3 illustrates the front plow assembly with a first arm disconnected from a second arm connected to a plow body.

Turning now to FIGS. 2 and 3, the plow assembly 100 will be described. Although the present description is being made for a snow plow, it is contemplated that other types of vehicle implement could be used. For example, the vehicle implement could be a loader bucket.

The plow assembly 100 includes a snow plow 102 and the push frame 104. In the lowered position, the snow plow 102 is upright and contacts the ground 2 on which the ATV 10 operates, and the push frame 104 is disposed generally parallel to the ground 2. It is contemplated that the snow plow 102 could be spaced from the ground 2 in the lowered position. In the raised position, the snow plow 102 is generally horizontal, and disposed vertically above the front portion 8 of the ATV 10 and at least partially rearward of a foremost point of the ATV 10 such that the snow plow 102 overlaps at least partially the front portion 8 of the ATV 10. While in the embodiment shown in the Figures, in the raised position, a majority of the snow plow 102 contacts the front platform 17, it is contemplated that the snow plow 102 could be spaced from the front platform 17. It is also contemplated that the ATV 10 could not have a front platform, and that the snow plow 102, in the raised position, could be disposed above or contact the front portion 8 deprived of front platform. In the raised position, the snow plow 102 is vertically above the headlights 27 of the ATV 10 and mostly rearward of the headlights 27. Similarly, the plow assembly 100' is vertically above and mostly forward of taillights 28 of the ATV 10. It is contemplated that the ATV 10 could have only one headlight and/or only one taillight. In the raised position, a surface 118 of the push frame has a shape generally complementary with the front portion 8 of the ATV 10 so as to be generally congruent with the front portion 8. Because, in the raised position, the push frame 104 follows a shape of the front portion 8 of the ATV 10, and the snow plow 102 is disposed mostly rearwards of the foremost point of the ATV 10, the plow assembly 100 is stowed on the ATV 10 and takes little floor space.

As best seen in FIG. 3, the snow plow 102 has a plow body 99, which is integrally formed of metal. It is contemplated that the plow body 99 could be made of a material other than metal. For example, the plow body 99 could be made of polymer. It is also contemplated that the plow body 99 could be surrounded by a frame or reinforcement members so as to enhance a rigidity of the plow body 99. It is contemplated that the plow body 99 could be articulated along one or more vertical pivot axis. For example, the plow body 99 could be hinged vertically along a center thereof. The plow body 99 has a width corresponding generally to a width of the ATV 10. It is contemplated that the plow body could be narrower or wider than a width of the ATV 10.

The plow body 99 has a front face 106, a rear face 108, a bottom edge 110, and a top edge 112. The front face 106 is the face that faces away from the ATV 10 when the snow plow 102 is in the lowered position. The rear face 108 is the face that faces toward the ATV 10 when the snow plow 102 is in the lowered position. The plow body 99 is mostly generally flat and has a curved portion 105 near the bottom edge 110. The bottom edge 110 is covered with a scraper blade 111 made of hard plastic. The scraper blade 111 is bolted to the front face 106 by bolts 113. The scraper blade 111 digs into the ground 2 and forces snow or dirt onto the curved portion 105. The bottom edge 110 also features a pair of sliders 151 provided near each end of the bottom edge 110. The sliders 151 slide on the ground 2 to prevent premature wear of the scraper blade 111. A vertical position of the sliders 151 with respect to the bottom edge 110 is adjustable. It is contemplated that the plow body 99 could have curved portions in addition to the curved portion 105. It is contemplated that the curved portion 105 could be omitted. It is contemplated that the scraper blade 111 could be omitted. It is contemplated that the scraper blade 111 could be made of a material other than plastic, such as metal. It is also contemplated that the scraper blade 111 could be pivotably mounted onto the plow body 99. It is contemplated that the sliders 151 could be omitted. It is contemplated that the sliders 151 could be replaced by ski-like elements. It is also contemplated that the vertical position of the sliders 151 with respect to the bottom edge 110 could be fixed.

The plow body 99 has a plurality of recesses 107 which reduce a weight of the snow plow 102. The plow body 99 includes several apertures 109. The apertures 109 are used by connectors for securing items onto the snow plow 102, when the snow plow 102 lies substantially flat in the raised position so that it can be used as a front platform or rack. An example of suitable connectors for the apertures 109 can be found in PCT application number PCT/US2010/040626, filed Jun. 30, 2010, the entirety of which is incorporated herein by reference. The recesses 107 provide traction for retaining the items secured on the rack when the snow plow 102 is used as a platform in the raised position. It is contemplated that the recesses 107 and/or the apertures 109 could be omitted. It is also contemplated that the recesses 107 could cover most of the plow body 99.

The snow plow 102 is pivotable about a vertical axis 4 so that the snow plow 102 can extend at an angle other than 90 degrees with respect to a longitudinal axis of the ATV 10. To pivot the snow plow 102 about the vertical axis 4, the user manually lifts a lever 103 located on the top edge 112 of the plow body 99. When the lever 103 is pulled, a cable 101 releases a swivel lock 166. The swivel lock 166 locks a swivel plate 167 in a specific position by engaging one of a plurality of notches 168 on the swivel plate 167. Once the swivel lock 166 is released, the user simply rotates the snow plow 102 so as to rotate the swivel plate 167 and engage the swivel lock 166 in the corresponding notch 168 of a desired position of the snow plow 102. By having the snow plow 102 skewed relative to the ATV 10, the snow or dirt being plowed will be pushed to one side of the ATV 10 as the ATV 10 moves forward. It is contemplated that the snow plow 102 could be disposed at positions that would not be predetermined by a position of the notches 168. It is contemplated that the user could adjust a position of the snow plow 102 directly from the handlebar 21. It is also contemplated that the snow plow 102 could be movable about the vertical axis 4 while being lifted between the lowered and raised positions. It is also contemplated that the snow plow 102 could be moved about the vertical axis 4 while the ATV 10 is in motion.

Still referring to FIG. 3, the push frame 104 connects the snow plow 102 near the bottom edge 110 of the plow body 99. It is contemplated that the push frame 104 could connect the snow plow 102 near a middle of the snow plow 102. The push frame 104 is made of several metal pieces. It is contemplated that some or all of the pieces of the push frame 104 could be made of a material other than metal. For example, the push frame 104 could be made of polymer.

The push frame 104 consists in a first arm 126 and a second arm 116. The first arm 126 and the second arm 116 are removably connected to each other by a connecting assembly 120. The connecting assembly 120, which will be described below, allows to quickly connect the first arm 126 to the second arm 116 by bringing them into contact. It is contemplated that the connection could not be achieved only by bring the two arms 116, 126 together. For example, the connection could be achieved by securing bolts between the arms 116 and 126. It is also contemplated that the connecting assembly 120 could be omitted and that the arms 116 and 126 could be fixedly connected to each other. It is contemplated that the arms 116 and 126 could be a single arm. When projected onto a longitudinal axis of the ATV 10, the second arm 116 has about a same length as the first arm 126. It is also contemplated that one of the first and second arms 126, 116 could be longer than the other one of the first and second arms 126, 116.

The first arm 126 is U-shaped. The U-shape is defined by two arm portions 124 and a curved end 121. It is contemplated that the first arm 126 could be a single arm.

The first arm 126 is pivotally connected to the frame 12 about a horizontal axis 3 at ends of the arm portions 124 distal from the curved end 121. A bracket 122, with which the first arm 126 is engaged, is bolted to the front portion 11 of frame 12. The user can, if desired, unbolt the bracket 122 so as to disconnect the first arm 126 from the frame 12, for example for those months where the plow assembly 100 is not used. It is contemplated that the bracket 122 could not be removable. The bracket 122 has apertures 123. As will be described below, the apertures 123 accommodate some of the components of a lifting assembly 150 (or 250).

A transverse arm 127 extends between the two arm portions 124. In the embodiment shown in the Figures, the transverse arm 127 contains the horizontal axis 3 around which the first arm 126 pivots, however it is contemplated that the transverse arm 127 could be spaced from horizontal axis 3.

A spring 157 is disposed around an end of the transverse arm 127. The spring 157 abuts the first arm 126 and the frame 12, and biases the first arm 126 toward the lowered position. It is contemplated that the spring 157 could be omitted. It is also contemplated that two springs 157 could be used.

A transverse rod 129, disposed toward the curved end 121, extends between the two arm portions 124. The transverse rod 129 provides structural resistance to the first arm 126. It is contemplated that the transverse rod 129 could be omitted, or that the first arm 126 could have more than one transverse rod 129.

A rod 130 is disposed toward a tip of the curved end 121. The rod 130 is used by the lifting assembly 150, described below, to secure a hook 154 of the winch 152 thereonto. The rod 130 is also used by a spring loaded lock 131 to secure the first arm 126 in the raised position. The lock 131, disposed on the bracket 122, locks the first arm 126 in the raised position when brought into contact with it. It is contemplated that the lock 131 could be omitted. It is contemplated that the rod used by the lock 131 could be distinct from the rod used by the hook 154. It is contemplated that the rod 130 could be disposed away from the tip of the curved end 121.

The curved end 121 is disposed at an angle 6 (shown in FIG. 2) with respect to the two arm portions 124. As can be seen in FIG. 11A, the angle 6 between the curved end 121 and the arm portions 124 is determined by a shape of the front portion 8 of the ATV 10, such that the first arm 126 has a shape complementary with the shape of a portion of the front portion 8 of the ATV 10 that it faces when the first arm 126 is in the raised position. As a result, in the raised position, the first arm 126 is congruent with the portion of the front portion 8 of the ATV 10 it faces when the first arm 126 is in the raised position. It is also contemplated that the curved end 121 could not be curved, but could be straight or pointy. The curved end 121 is covered by a wear pad 141. The wear pad 141 minimizes wear that may happen between the first arm 126 and the second arm 116 when they are brought into contact. It is contemplated that the wear pad 141 could be omitted. The curved end also features two knobs 145 disposed on each side thereof. The knobs 145 selectively abut recesses 146 of the second arm 116. It is contemplated that none or only one knob 145 could be used. An aperture 142 disposed at the tip of the curved end 121 mates with a pin (not shown) in the second arm 116. The aperture 142 and pin, as well as the curvature of the curved end 121, facilitate alignment of the first arm 126 and the second arm 116 when they are brought into contact for connection.

A hook 128 is disposed on the tip of the curved end 121. The hook 128 selectively hooks the second arm 116 when the second arm 116 is brought into contact with the first arm 126. A cable (not shown), operable by a user from the handlebar 21, is connected to the hook 128. When the cable is pulled, the hook 128 is lifted and the first arm 126 becomes disconnected from the second arm 116. The curved end 121 and the hook 128 form a male portion of the connecting assembly 120 for connecting the first arm 126 to the second arm 116. The female portion of the connecting assembly 120 will be described below with respect to the second arm 116.

The second arm 116 is connected to the snow plow 102, and selectively connected to the first arm 126 at a hollow end 119. The hollow end 119 is the female part that receives the curved end 121 of the first arm 126 for connecting the first arm 126 to the second arm 116. The hollow end 119 also includes a retaining knob (not shown) on which the hook 128 hooks. It is also contemplated that the second arm 116 could have the male connector and the first arm 126 could have the female connector. As best seen in FIG. 2, the hollow end 119 is disposed at an angle 7 with respect to a rest of the second arm 116. The angle 7 between the hollow end 119 and the rest of the second arm 116 is determined by the shape of the front portion 8 of the ATV 10. The second arm 116 has a shape complementary with the shape of a portion of the front portion 8 of the ATV 10 that it faces when the push frame 104 (and thus the second arm 116) is in the raised position. As a result, in the raised position, the second arm 116 is congruent with the portion of the front portion 8 of the ATV 10 it faces when the second arm 116 is in the raised position. It is contemplated that the hollow end 119 could not be angled with respect to the rest of the second arm 116.

At the end of the second arm 116 opposite to the hollow end 119, a connection member 114 pivotally connects the snow plow 102 to the second arm 116. The connection member 114 includes two spring and damping assemblies 115 such as the rubber suspension systems from Rosta®. The assemblies 115 provide spring, damping, tensioning and bearing functions. The spring function bias the snow plow 102 toward a position where the sliders 151 are contacting the ground 2 when the snow plow 102 is in lowered position (as shown in FIG. 2). The assemblies 115 allow the snow plow 102 to be pivotable with respect to the second arm 116 about a horizontal axis 5 so as to accommodate uneven grounds. The bottom edge 110 can, due to this pivotal connection, follow the ground 2 has it raises and lowers, due to bumps for example. A compact design of the assemblies 115 does not interfere with the front portion 8 of the ATV 10 when the plow assembly 100 is stowed in the raised position. It is contemplated that the snow plow 102 could be fixed to the second arm 116 about the horizontal axis 5. It is contemplated that the connection member 114 could have only one spring and damping assembly. It is also contemplated that the connection member 114 could instead have a torsion spring only. It is contemplated that the snow plow 102 could be fixed to the push frame 104, and that the assemblies 155 could instead be connected to the scrapper blade 111 for allowing the scrapper blade 111 to pivot. A bottom of the second arm 116 has a bumper 169. The bumper 169 attenuates impacts should the second arm 116 contact the ground 2. The bumper 169 also provides a contact point for the second arm 116 when the second arm 116 is disposed on the ground 2 when the snow plow 102 and the second arm 116 are detached from the first arm 126. It is contemplated that the bumper 169 could be omitted. As mentioned above, the swivel lock 166 is disposed onto the second arm 116.

When the user wants to connect the first arm 126 to the second arm 116 for assembling the plow assembly 100, the user disposes the snow plow 102 with the second arm 116 connected thereto onto the ground 2 in front of the ATV 10. If not previously done, the user operates the lifting assembly 150 (or 250) via the button 23 on the handlebar 21 to move the first arm 126 from the stowed position (i.e. raised position) to a position for connecting to the second arm 116 (i.e. lowered position). The user then drives slowly toward the snow plow 102 for engaging the first arm 126 into the hollow end 119 until the hook 128 is engaged with the second arm 116. Once hooked, the user can lift the plow assembly 100 using the button 23.

To disconnect the first arm 126 from the second arm 116, the user positions the plow assembly 100 in the lowered position, resting on the ground 2. The user pulls the cable connected to the hook 128 to unhook the first arm 126 from the second arm 116. The user can then stow the first arm 126 by operating the lifting assembly 150 (or 250) to lift the first arm 126 to the raised position. A detailed operation of the lifting assembly 150 (or 250) will be described below.

Still referring to FIGS. 2 and 3, a first embodiment of the lifting assembly 150 for the plow assembly 100 will be described.

The lifting assembly 150 includes a winch 152 fixedly connected to the front portion 11 of the frame 12, a cable 153 wound around the winch 152, and a hook 154 at an end of the cable 153. The winch 152 is disposed behind the bracket 122, vertically above the connection of the first arm 126 to the frame 12. A roller box 155 is disposed in front of the winch 152 connected to an external side of the bracket 122. The roller box 155 is composed of four rollers 156 (shown in FIG. 6) secured to the bracket 122. The rollers 156 are disposed so as to form a square. Each of the rollers 156 acts as a pulley for the cable 153. The hook 154 is hooked to the rod 130. The roller box 155, one of the apertures 123 and the winch 152 are aligned with each other so that the cable 153 goes from the winch 152 through the aperture 123 and through the roller box 155, and extends to the first arm 126. It is contemplated that some or all of the rollers 156 could be omitted. It is contemplated that the winch 152 could be located toward a vertically middle portion of the front portion 11 of the frame 12 as opposed to the bottom 28 of the front portion 11 of frame 12. It is also contemplated that the four rollers 156 could be disposed in a rectangle. It is also contemplated that the lifting assembly 150 could have the winch 152 replaced by a hydraulic or electric actuating mechanism.

When the cable 153 is wound around the winch 152, the first arm 126 is lifted and pivoted toward the raised position. When the cable 153 is unwound, the first arm 126, under the influence of the spring 157 and of gravity, tensions the cable 153 to move the first arm 126 toward the lowered position in a controlled manner. Although the hook 154 is releasable from the first arm 126, it is contemplated that the hook 154 could be always engaged with the first arm 126. It is also contemplated that the hook 154 could be detached from the transverse rod 129 so that the winch 152 is used for purposes other than lifting the plow assembly 100, when the plow assembly 100 is in the lowered and/or stowed positions, similarly to what is described below for a second embodiment of the lifting assembly 250.

Figure 5:
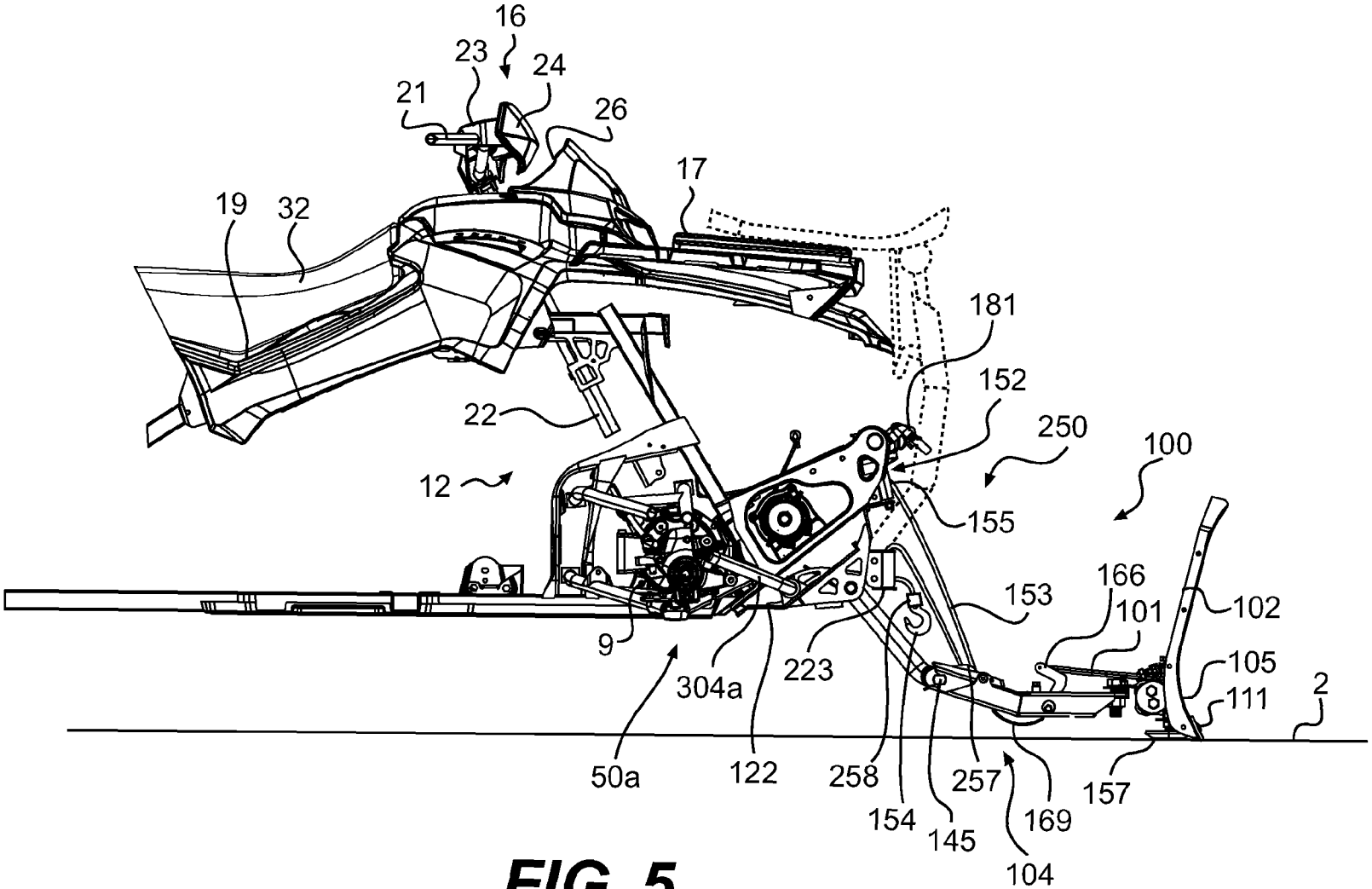
FIG. 5 is a right side elevation view of the forward end of the ATV of FIG. 4, with some elements removed for clarity and with a stowed position of the front plow assembly shown in dotted lines.
Figure 6:
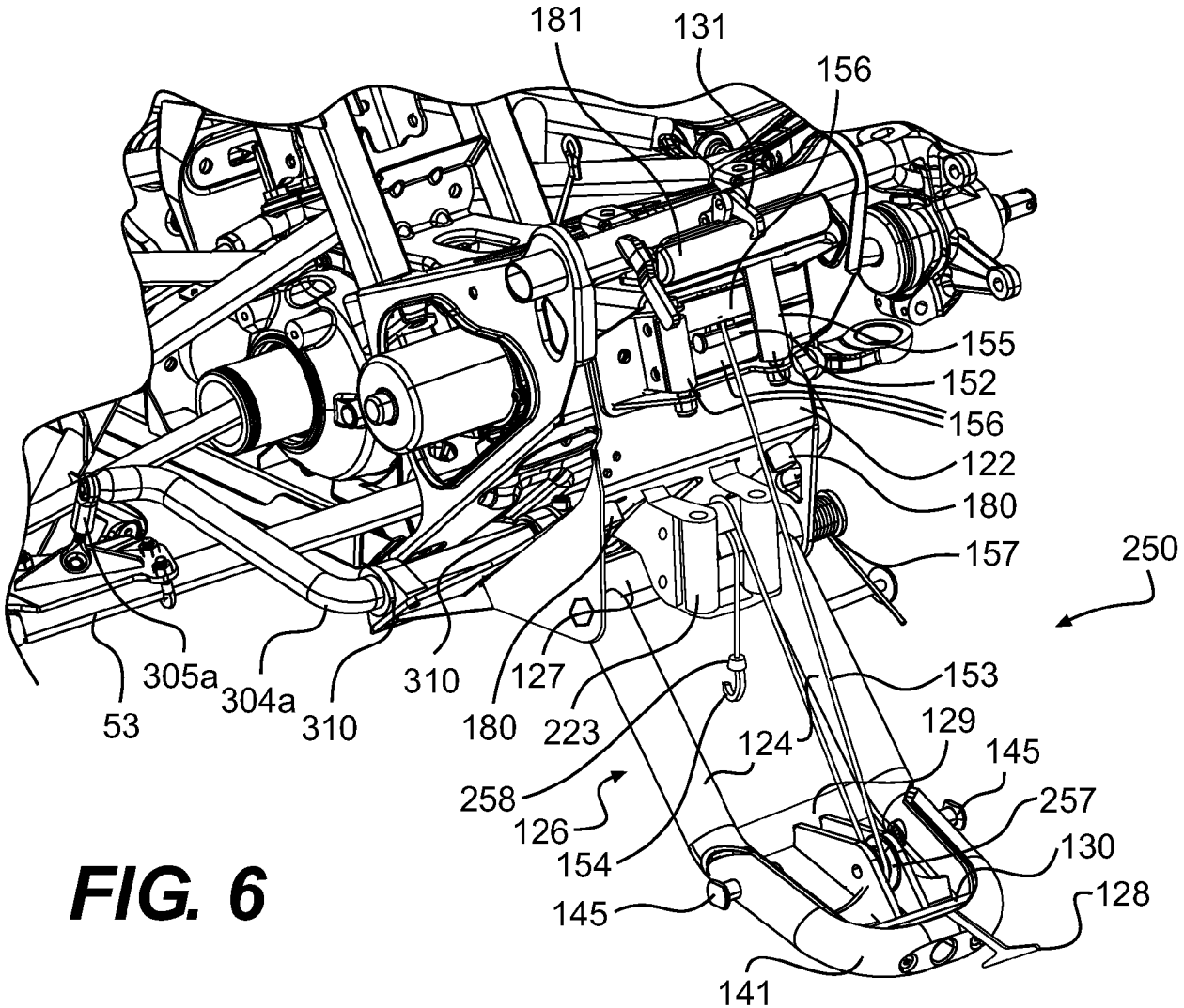
FIG. 6 is a perspective view taken from a front, right side of a forward end of the ATV of FIG. 4 with some elements removed for clarity.

Turning now to FIGS. 4 to 6, the second embodiment of the lifting assembly 250 will be described. The lifting assembly 250 includes the winch 152, the cable 153, and the hook 154. Elements of the lifting assembly 250 common to the lifting assembly 150 have been given the same reference numeral and will not be described in greater detail herein again.

As best seen in FIG. 6, the cable 153 is not engaged with the rod 130 but is engaged in a pulley 257 disposed between the two arm portions 124 and toward the curved end 121, and a roller box 223 disposed on the frame 12. Thus, contrary to the lifting assembly 150, the hook 154 in the lifting assembly 250 is not engaged with the rod 130 but is free, which allows of use the winch 152 without having to disconnect the elements used to lift the plow assembly 100. Once the plow assembly 100 is locked in the raised position, the user can reach for the hook 154 between arm portions 124 of the first arm 126 to use the winch 152 for purposes not related to lifting the plow assembly 100, while the plow assembly 100 remains locked in the raised position. The winch 152 can similarly be used when the plow assembly 100 is in the lowered position. The lock 131 is releasable by the user via a cable (not shown) pulled from the handlebar 21.

The roller box 223 is connected to the frame 12 via the bracket 122. The roller box 223 consists in four rollers disposed in a square above the connection of the first arm 126 to the frame 12. The roller box 223 is dimensioned so that an abutment member 258 of the hook 154 abuts it when the cable 153 is wound on the winch 152. Thus, when the cable 153 is wound around the winch 152, the abutment member 258 eventually becomes in abutment with the roller box 253. Once the abutment takes place, further winding the cable 153 around the winch 152 results in lifting the plow assembly 100 off the ground 2 by pulling the first arm 126 toward the front portion 8 of the ATV 10. It is contemplated that some or all of the rollers of the roller box 223 could be replaced by a pulley and a retaining member.

Turning now to FIGS. 7 to 11B, the suspension limiter 300 will now be described. The suspension limiter 300 will be described in conjunction with the lifting assembly 250, however, it is contemplated that the suspension limiter 300 could be used in conjunction with the lifting assembly 150, or with another type of lifting assembly.

The suspension limiter 300 prevents the front suspension assemblies 50*a*, 50*b* (either one or both) to move upwards relative to the frame 12 when the plow assembly 100 is in positions intermediate the lowered and raised positions. It is desirable to restrict movement of the front suspension assemblies 50*a*, 50*b* when the plow assembly 100 is between the lowered and raised positions, because otherwise in those positions, the plow assembly 100 induces a moment which pitches the front portion 8 of the ATV 10 downwardly. In addition, restricting the front suspension assemblies 50*a*, 50*b* insures a minimum ground clearance. It is also desirable to not restrict the front suspension assemblies 50*a*, 50*b* when the plow assembly 100 is in either the lowered or raised positions, to help accommodate uneven grounds. Although the suspension limiter 300 is described herein to be mechanically linked to the plow assembly 100, it is contemplated that the suspension limiter 300 could be electrically or electronically controlled. It is contemplated that when the ATV 10 has the plow assembly 100', the rear suspension assemblies 52 could have one or more suspension limiters. It is also contemplated that the suspension limiter 300 could restrict movement of the front suspension assemblies 50*a*, 50*b* when the plow assembly 100 is in the lowered position only.

The suspension limiter 300 includes a right suspension limiter 300*a*, and a left suspension limiter 300*b*. It is contemplated that the ATV 10 could have only one suspension limiter for locking both the right and left front suspension assemblies 50*a*, 50*b*. It is contemplated that the ATV 10 could have more than one suspension limiter. The right suspension limiter 300*a* includes a stopper 302, a right swivel arm 304*a*, and a right fork 306*a*. The left suspension limiter 300*b* includes the stopper 302, a left swivel arm 304*b*, and a left fork 306*b*.

Figure 8:
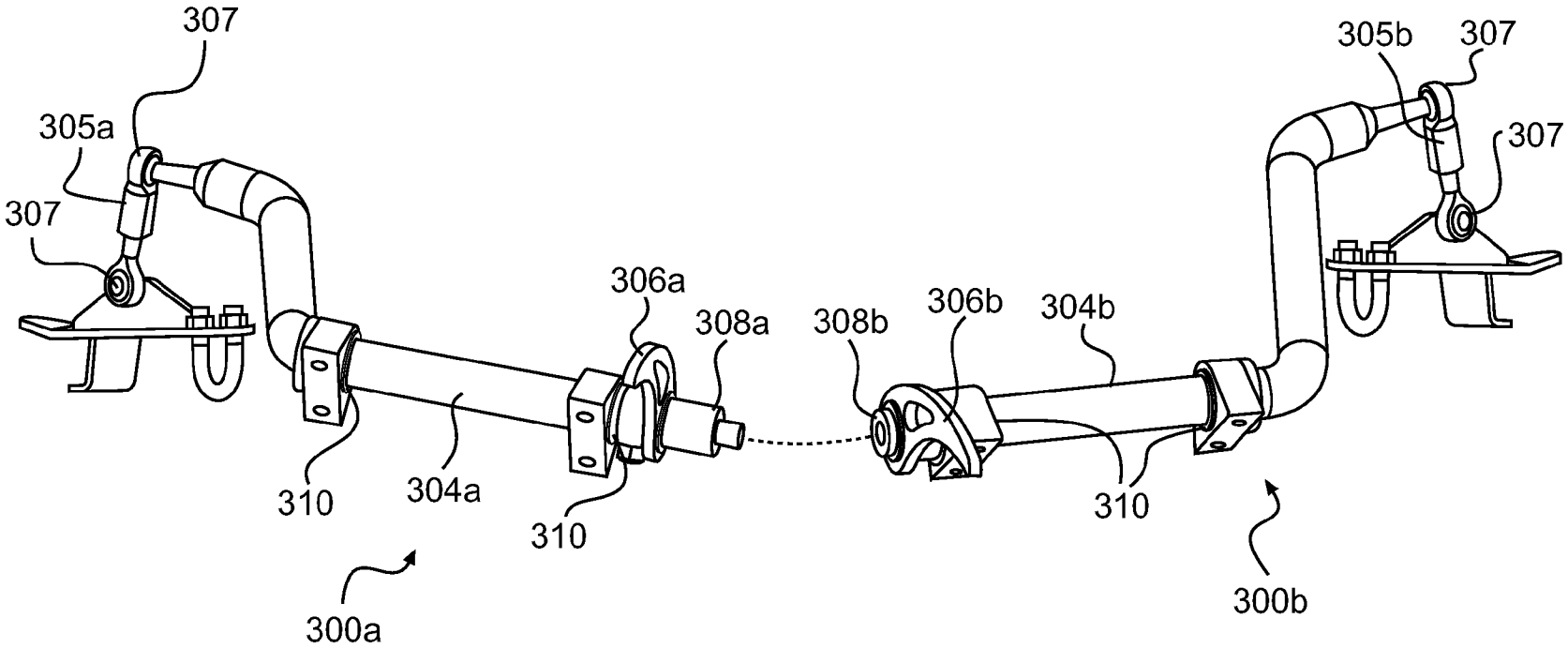
FIG. 8 is a partial exploded view of a portion of the suspension limiter of FIG. 7.

Referring more specifically to FIG. 8, the swivel arms 304*a*, 304*b* are rotatably connected to the lower A-arms 53 of the front suspension assemblies 50*a*, 50*b* via respective rods 305*a*, 305*b*. The rods 305*a*, 305*b* have ball joints 307 at each end thereof. The ball joints 307 transmit movement of the front suspension assemblies 50*a*, 50*b* to the swivel arms 304*a*, 304*b* respectively. It is contemplated that a rotational connection between the A-arms 53 and the swivel arms 304*a*, 304*b* could be achieved differently. It is also contemplated that the swivel arms 304*a*, 304*b* could be connected to parts of the front suspension assemblies 50*a*, 50*b* other than the A-arms 53.

The swivel arms 304*a*, 304*b* are connected to each other at ends opposite to their connections to the lower A-arms 53. The right swivel arm 304*a* has a male end 308*a* that connects to a female end 308*b* of the left swivel arm 304*b*. A nylon bushing is disposed between the male end 308*a* and the female end 308*b*. It is contemplated that the left swivel arm 304*b* could have the male end 308*a*, and the right swivel arm 304*a* could have the female end 308*b*. It is contemplated that the swivel arms 304*a*, 304*b* could not be directly connected to each other. It is contemplated that the swivel arms 304*a*, 304*b* could form a single arm. It is contemplated that the right swivel arm 304*a* could have the female end 308*b*, and the left swivel arm 304*b* could have the male end 308*b*.

The forks 306*a*, 306*b* are fixedly connected to their respective swivel arm 304*a*, 304*b* proximate to the ends 308*a*, 308*b*. The forks 306*a*, 306*b* are secured thereonto, and the user can unsecure them for adjusting their angular position on the swivel arms 304*a*, 304*b*. This is the case for example when the user desires to adjust positions for which the front suspension assemblies 50*a*, 50*b* will be restricted, or for example to compensate for a weight of the user and/or cargo, which has a direct influence on the front suspension assemblies 50*a*, 50*b*. Alternatively, a length of the rods 305*a* or 305*b* could be adjustable in order to allow the user to modify the angular position of the forks 306*a*, 306*b*. It is contemplated that only one fork 306*a*, 306*b* could be used.

Four bearings 310 (two per swivel arm 304*a*, 304*b*) pivotally connect the swivel arms 304*a*, 304*b* to the frame 12 via the bracket 122. It is contemplated that more or less than four bearings 310 could be used. It is contemplated that the bearings 310 could be omitted, and that the swivel arms 304*a*, 304*b* could be otherwise pivotally connected to the bracket 122 via a bushing or by forming a journal bearing with the bracket 122, for example.

Figure 7:
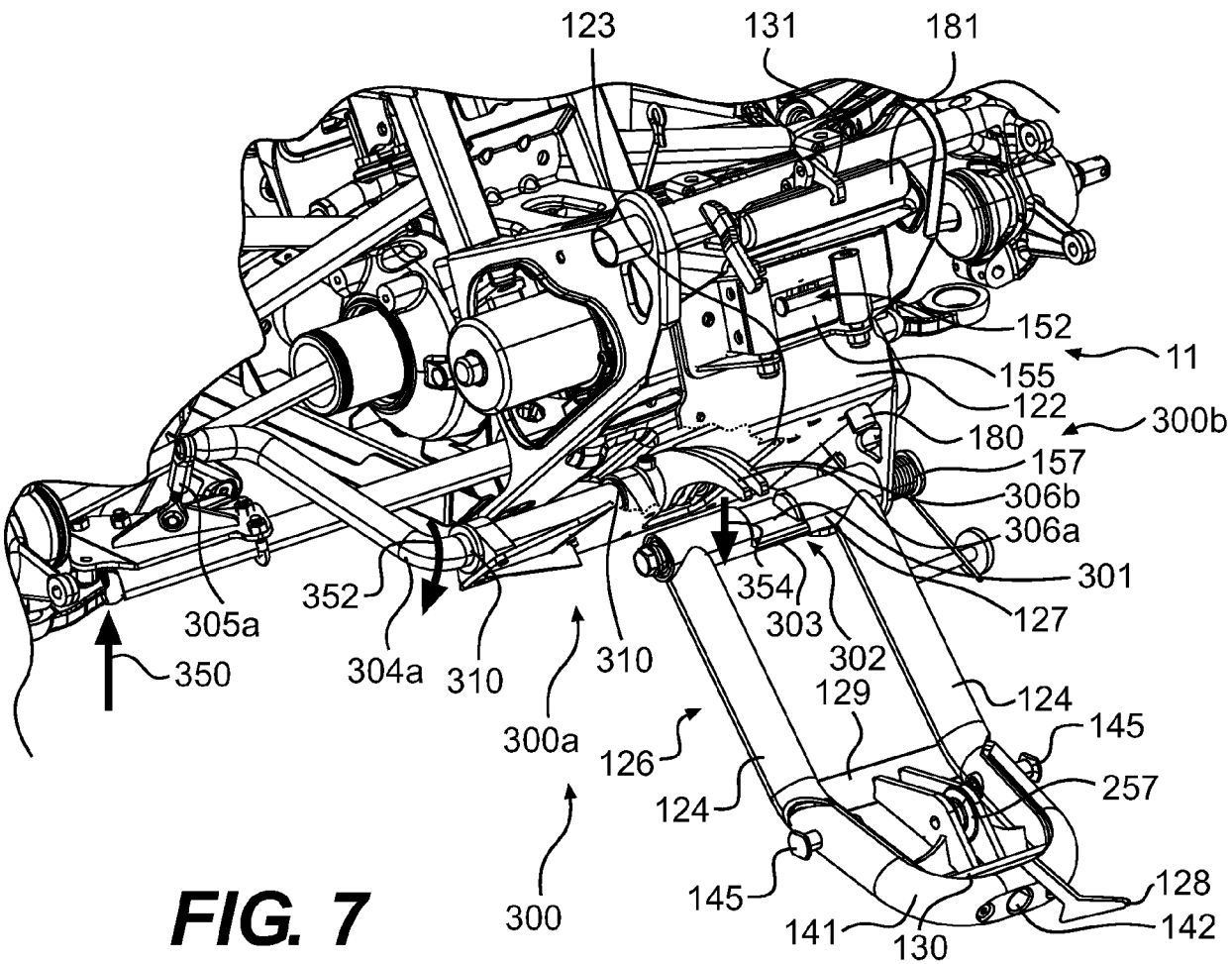
FIG. 7 is a perspective view taken from the front, right side of the forward end of the ATV of FIG. 6, with some elements removed to reveal a suspension limiter and the first arm of the front plow assembly.

A movement of the swivel arms 304*a*, 304*b* is as follows. The ends of the swivel arms 304*a*, 304*b* proximate to the rods 305*a*, 305*b* move with the front suspension assemblies 50*a*, 50*b*, which causes the swivel arms 304*a*, 304*b* to pivot within the bearings 310 relative to the bracket 122. Referring to FIG. 7 in particular, when the plow assembly 100 is lifted or when the ATV 10 drives over a bump, for example, the shock absorbers 38 shorten and the A-arms 53 move generally upward relative to the frame 12. As a result, the ends of swivel arms 304*a*, 304*b* proximate to the rods 305*a*, 305*b* respectively, move in the direction 350 which forces the swivel arms 304*a*, 304*b* to rotate in the direction illustrated by arrow 352 and the forks 306*a*, 306*b* to move in the direction illustrated by arrow 354 toward the stopper 302. Oppositely, when the shock absorbers 38 extend and the A-arms 53 move generally downward relative to the frame 12, as it is the case when the plow assembly 100 is on the ground or when the ATV 10 drives over a hole, the end of swivel arms 304*a*, 304*b* proximate to the rods 305*a*, 305*b* respectively move in the direction 351 (shown in FIG. 4) which forces the swivel arms 304*a*, 304*b* to rotate in the direction opposite to the arrow 352 and the forks 306*a*, 306*b* to move in the direction opposite to the arrow 354 away from the stopper 302.

Figure 9B:
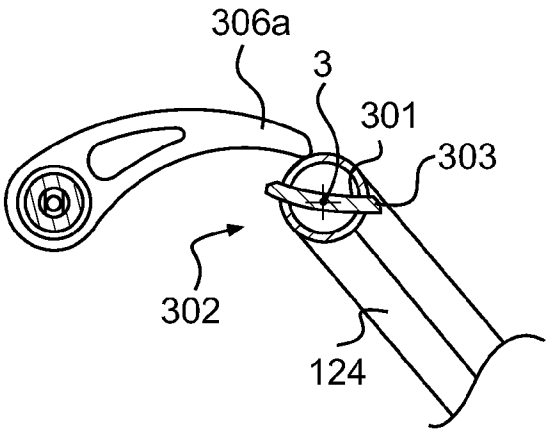
FIG. 9B is a close-up cross-sectional view of a portion of the suspension limiter of FIG. 9A.

Referring back to FIG. 7, the stopper 302 is located on the transverse arm 127. The stopper 302 includes a curved plate 301. The plate 301 has two chamfered flanges 303. A radius of curvature of the plate 301 is determined by a path defined by tips of the forks 306*a*, 306*b* as they rotate with the swivel arms 304*a*, 304*b*. As shown in FIG. 9B, the horizontal axis 3 passes through the curved plate 301. It is contemplated that the stopper 302 could have a shape different from the one shown in the Figures. It is contemplated that the plate 301 could be V-shaped or straight. It is contemplated that the stopper 302 could have no or only one chamfered flange 303. It is contemplated that the horizontal axis 3 could be offset from the curved plate 301. It is contemplated that the stopper 302 could include two distinct stoppers, one for each of the suspension limiters 300*a*, 300*b*. It is also contemplated that the stopper 302 could be disposed above or below the arm portions 124.

Referring to FIGS. 9A to 11B, different positions of the forks 306*a*, 306*b* and stopper 302 will now be described for different positions of the plow assembly 100. In the examples described below, it is assumed that the ATV 10 is either not moving or moving on even ground, such that the forks 306*a*, 306*b* move in unison and are moved due to the position of the plow assembly 100 (and not due to unevenness of the ground).

Figure 9A:
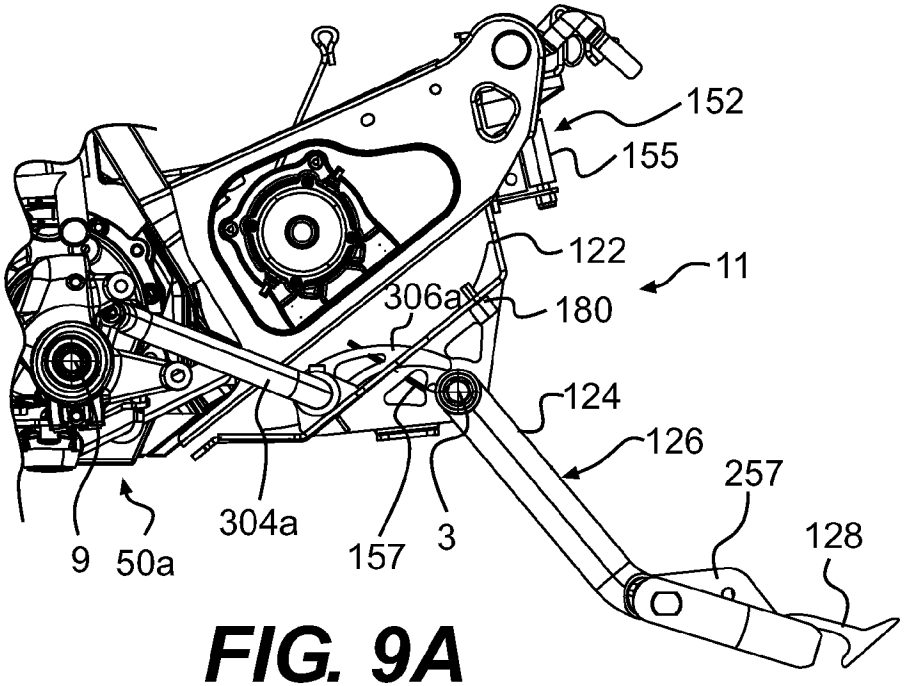
FIG. 9A is a right side elevation view of the forward end of the ATV of FIG. 6 with some elements removed with the first arm in a lowered position.

FIGS. 9A and 9B illustrate a position of the forks 306*a*, 306*b* and of the stopper 302 when the plow assembly 100 is in the lowered position. As mentioned above, in the lowered position, the plow assembly 100 rests on the ground 2 and a majority of a weight of the plow assembly 100 is not supported by the front suspension assemblies 50*a*, 50*b*. The shock absorbers 38 are in a first state of compression. The A-arms 53 are in a first position where the swivel arms 304*a*, 304*b* are positioned so that the forks 306*a*, 306*b* are in a lowered position. The stopper 302, due to the position of the first arm 126, is in a first orientation such that, the forks 306*a*, 306*b* are disposed away from the stopper 302. As a result, the front suspension assemblies 50*a*, 50*b* are unrestricted. A gap between the tips of the forks 306*a*, 306*b* and the stopper 302 is sufficient to allow some suspension movement. This could be the case, for example, when the user is shifting its own weight. Also, the forks 306*a*, 306*b* and stopper 302 are dimensioned so that when the ATV 10 is not in operation but is loaded with a user and/or cargo, the forks 306*a*, 306*b* cannot be disposed lower than the plate 301.

Figure 10B:
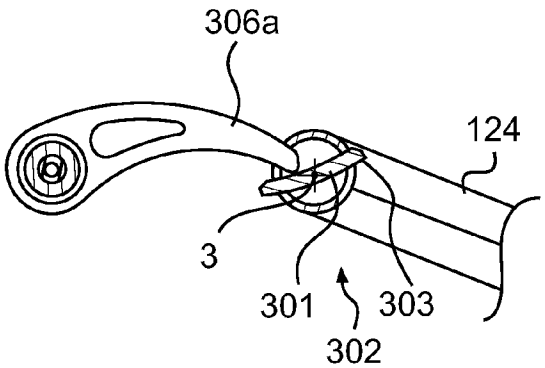
FIG. 10B is a close-up cross-sectional view of the portion of the suspension limiter of FIG. 10A.
Figure 10A:
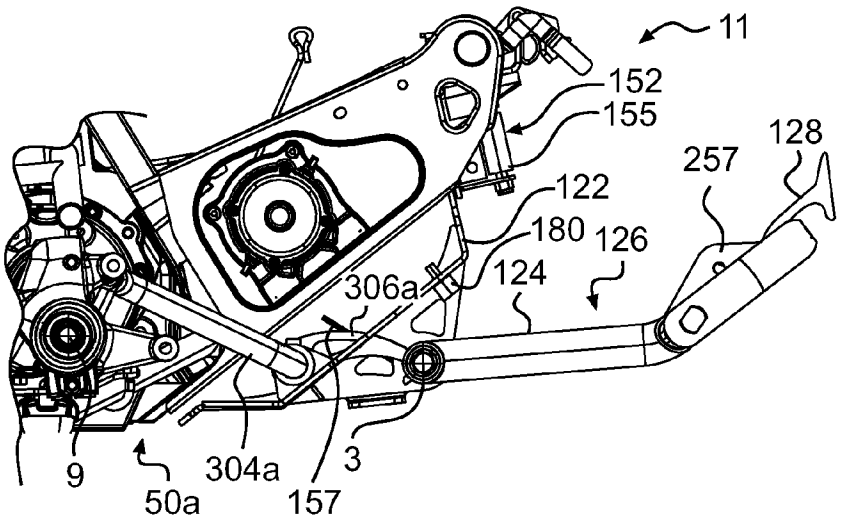
FIG. 10A is a right side elevation view of the forward end of the ATV of FIG. 6 with the first arm in an intermediate position.

FIGS. 10A and 10B illustrate a position of the forks 306*a*, 306*b* and of the stopper 302 when the plow assembly 100 is in a position intermediate the lowered and raised positions. When the plow assembly 100 is lifted off the ground 2, the weight of the plow assembly 100 is transferred to the front suspension assemblies 50*a*, 50*b* and a moment is created. The shock absorbers 38 are compressed in a second state of compression, and the A-arms 53 are in a second position generally upward compared to the first position. As a result, the ends of the swivel arms 304*a*, 304*b* connected to the front suspension assemblies 50*a*, 50*b* move upwards in the direction 350. The swivel arms 304*a*, 304*b* pivot in the direction 352, which in turn move the forks 306*a*, 306*b* downward in the direction 354. At the same time, the stopper 302 is moved to be in a second orientation due to the pivoting of the first arm 126. The forks 306*a*, 306*b* and stopper 302 are so dimensioned that when the forks 306*a*, 306*b* move downwards due to the weight and moment created and when the stopper 302 is moved to the second orientation, the forks 306*a*, 306*b* come into contact with the plate 301. When contact is established, the front suspension assemblies 50*a*, 50*b* cannot move in the direction 350 anymore, and are thus restricted. The front suspension assemblies 50*a*, 50*b* can, however, move in the direction 351, such that the front suspension assemblies 50*a*, 50*b* can extend in response to rolling over a hole in the ground 2, for example. It is contemplated that the front suspension assemblies 50*a*, 50*b* could also be restricted in the direction 351 when they are restricted in the direction 350.

Figure 11B:
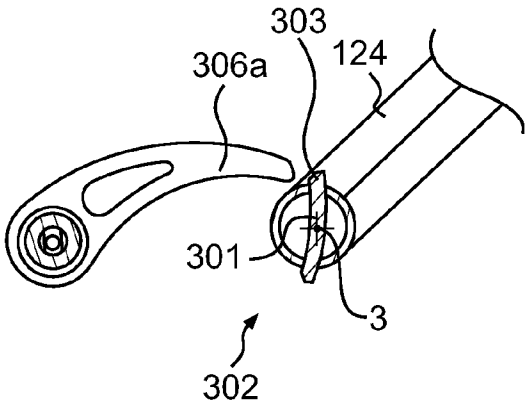
FIG. 11B is a close-up cross-sectional view of the portion of the suspension limiter of FIG. 11A.
Figure 11A:
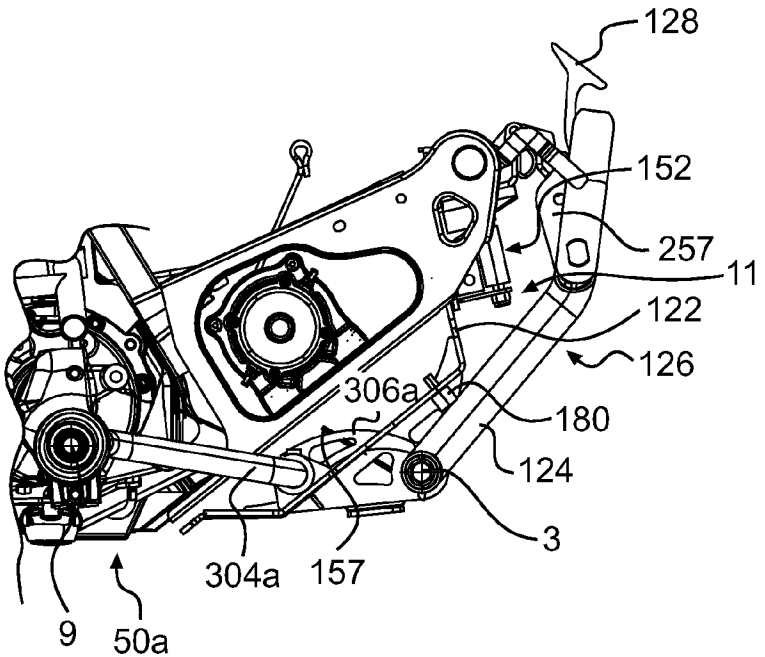
FIG. 11A is a right side elevation view of the forward end of ATV of FIG. 6 with the first arm in a raised position.

FIGS. 11A and 11B illustrate a position of the forks 306*a*, 306*b* and of the stopper 302 when the plow assembly 100 is in the raised position. When the plow assembly 100 reaches the raised position, a weight of the plow assembly 100 is still supported in part by the front suspension assemblies 50*a*, 50*b*, but less moment is created since the plow assembly 100 rests on the front platform 17 vertically above the front suspension assemblies 50*a*, 50*b*. The shock absorbers 38 are in a third state of compression and the A-arms 53 are in a third position generally downward compared to the second position. The forks 306*a*, 306*b* move upwards compared to the second position they had when the plow assembly 100 was in the position intermediate the lowered and raised position. The stopper 302 has been moved by the first arm 126 to be in a generally vertical third orientation. The pair of forks 306*a*, 306*b* does not abut the plate 301, so that the front suspension assemblies 50*a*, 50*b* become unrestricted. The chamfered flange 303 provides a smooth contact should the forks 306*a*, 306*b* become in contact with the stopper 302 when, for example, the ATV 10 drives over an uneven ground when the plow assembly 100 is in the raised position, thus preventing restriction of the movement of the front suspension assemblies 50*a*, 50*b*.

As the plow assembly 100 is moved away from the raised position, the stopper 302 changes orientation. Simultaneously, a moment is created and the forks 306*a*, 306*b* move downwards compared to the position in which they were when the plow assembly 100 was in the raised position. They then come into abutment with the plate 301 to restrict the front suspension assemblies 50*a*, 50*b* in the direction 350.

As mentioned above, the left and right swivel arms 304*a*, 304*b* are rotatably connected to each other. Thus, the swivel arms 304*a*, 304*b* can rotate independently from each other in the directions that are not restricted when the snow plow 102 is in the positions intermediate the lowered and raised positions. For example, when driving with the snow plow 102 in one of the positions intermediate the lowered and raised positions, the left fork 306*b* can become spaced from the stopper 302 when the ATV 10 drives over a hole with the left front wheel 14 only, while the right fork 306*a* still abuts the stopper 302.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A motorized vehicle comprising:

a frame;

an engine supported by the frame;

left and right ground engaging members operatively connected to the frame;

left and right suspensions connected to the frame, the left suspension being operatively connected to the left ground engaging member, the right suspension being operatively connected to the right ground engaging member, when in operation, the left and right suspensions moving in predetermined directions;

a vehicle implement pivotally connected to one of a front portion and a rear portion of the frame by at least one arm, the vehicle implement being pivotable between a first position and a second position, the second position being vertically higher than the first position; and at least one suspension limiter operatively connected to the at least one arm, when the vehicle implement is in the first and second positions, the left and right suspensions are free to move in the predetermined directions, and when the vehicle implement is in a position intermediate the first and second positions, the at least one suspension limiter restricts movement of the left and right suspensions in at least one of the predetermined directions.

2. The motorized vehicle of claim 1, wherein when the vehicle implement is in a position intermediate the first and second positions, the left and right suspensions can move independently in at least one of the predetermined directions other than the at least one of the predetermined directions.

3. The motorized vehicle of claim 1, wherein the at least one suspension limiter includes a left suspension limiter and a right suspension limiter; and when the vehicle implement is in a position intermediate the first and second positions, the left and right suspension limiters restrict movement of the left and right suspensions respectively in the at least one of the predetermined directions.

4. The motorized vehicle of claim 1, wherein the at least one suspension limiter comprises:

at least one stopper connected to the vehicle implement; and at least one engagement member connected to the left and right suspensions, the at least one engagement member being in selective abutment with the at least one stopper, when the vehicle implement is in the first and second positions, the at least one engagement member is spaced from the at least one stopper, and when the vehicle implement is in the position intermediate the first and second positions, the at least one engagement member selectively abuts the at least one stopper, an abutment between the at least one stopper and the at least one engagement member preventing the left and right suspensions to move in the at least one of the predetermined directions.

5. The motorized vehicle of claim 4, wherein the at least one stopper includes a curved plate.

6. The motorized vehicle of claim 4, wherein the at least one suspension limiter further comprises:

at least one swivel arm rotatably connected to the left and right suspensions, the at least one swivel arm being rotatably connected to the frame, the at least one engagement member being fixedly connected to the at least one swivel arm.

7. The motorized vehicle of claim 1, wherein the at least one suspension limiter comprises:

at least one stopper connected to the vehicle implement;

at least one engagement member connected to the left and right suspensions;

a left swivel arm rotatably connected to the left suspension; and a right swivel arm rotatably connected to the right suspension;

the at least one engagement member is in selective abutment with the at least one stopper;

the left swivel arm and the right swivel arm are rotatably connected to the frame;

the at least one engagement member includes a left engagement member and a right engagement member;

the right engagement member is fixedly connected to the right swivel arm;

the left engagement member is fixedly connected to the left swivel arm;

when the vehicle implement is in the first and second positions, the left and right engagement members are spaced from the at least one stopper, when the vehicle implement is in the position intermediate the first and second positions, at least one of the right and left engagement members selectively abuts the at least one stopper, an abutment between the at least one stopper and the at least one of the left and right engagement members preventing the left and right suspensions to move in the at least one of the predetermined directions, and the left and right suspensions can move independently from one another in the at least one of the predetermined directions other than the at least one of the predetermined directions.

8. The motorized vehicle of claim 6, wherein the at least one arm is pivotally connected to the frame by a bracket; and the at least one swivel arm is rotatably connected to the bracket.

9. The motorized vehicle of claim 6, wherein movement of at least one of the left and right suspensions induces a rotation of the at least one swivel arm and of the at least one engagement member.

10. The motorized vehicle of claim 6, wherein the at least one engagement member includes at least one fork; and the at least one stopper is disposed on an end of the at least one arm distal from the vehicle implement.

11. The motorized vehicle of claim 10, wherein the at least one arm includes two arm portions and a transverse rod extending between the two arm portions; and the at least one stopper is defined by the transverse rod.

12. The motorized vehicle of claim 11, wherein the at least one stopper includes a curved plate;

the vehicle implement is pivotable between the first and second positions about a horizontal axis;

the horizontal axis extends longitudinally through the transverse rod; and the horizontal axis passes through the curved plate.

13. The motorized vehicle of claim 1, wherein the motorized vehicle is an all-terrain vehicle and the at least one ground engaging member is four wheels.

14. The motorized vehicle of claim 1, further comprising a lock disposed on at least one of the at least one arm and the frame, the lock locking the at least one arm in the second position.

15. The motorized vehicle of claim 1, wherein the at least one arm has a shape at least partially generally complementary with a portion of a corresponding one of a front portion and a rear portion of the vehicle.

16. The motorized vehicle of claim 15, further comprising a lifting assembly for pivoting the vehicle implement between the first and second positions, the lifting assembly including:

a winch disposed on the one of the front portion and the rear portion of the frame;

a cable wound on the winch, the cable being engaged with the at least one arm, the cable having a free end;

a hook connected to the free end of the cable; and wherein winding the cable around the winch causes the at least one arm to move toward the second position, and when the at least one arm is locked in the second position, the cable can be wound and unwound around the winch and the at least one arm remains in the second position.

17. The motorized vehicle of claim 1, wherein the at least one arm is removably connected to the vehicle implement, and when in the first position, the at least one arm is in a position for connection with the vehicle implement.

18. A motorized vehicle comprising:

a frame;

an engine supported by the frame;

left and right ground engaging members operatively connected to the frame;

left and right suspensions connected to the frame, the left suspension being operatively connected to the left ground engaging member, the right suspension being operatively connected to the right ground engaging member, when in operation, the left and right suspensions moving in predetermined directions;

a vehicle implement pivotally connected to one of a front portion and a rear portion of the frame by at least one arm, the vehicle implement being pivotable between a first position and a second position, the second position being vertically higher than the first position; and at least one suspension limiter operatively connected to the at least one arm, the at least one suspension limiter including:

at least one stopper connected to the vehicle implement;

a right engagement member connected to the right suspension, the right engagement member being in selective abutment with the at least one stopper;

a left engagement member connected to the left suspension, the left engagement member being in selective abutment with the at least one stopper;

a left swivel arm rotatably connected to the left suspension and to the frame, the left engagement member being fixedly connected to the left swivel arm; and a right swivel arm rotatably connected to the right suspension and to the frame, the right engagement member being fixedly connected to the right swivel arm;

when the vehicle implement is in the first position, the left and right engagement members are spaced from the at least one stopper and the left and right suspensions are free to move in the predetermined directions, and when the vehicle implement is in a position other than the first position, at least one of the right and left engagement members selectively abuts the at least one stopper, an abutment between the at least one stopper and the at least one of the left and right engagement members preventing the left and right suspensions to move in the at least one of the predetermined directions, and the left and right suspensions can move independently from one another in the at least one of the predetermined directions other than the at least one of the predetermined directions.

19. A suspension limiter for a suspension assembly of a motorized vehicle, the suspension assembly being movable in predetermined directions, the limiting assembly comprising:

at least one swivel arm adapted to be connected to the suspension assembly;

at least one bearing on the at least one swivel arm, the at least one bearing being adapted to be connected to a frame of the motorized vehicle;

at least one stopper adapted to be movably connected to the frame; and at least one engagement member fixedly connected to the at least one swivel arm, the at least one engagement member selectively abutting the at least one stopper, an abutment between the at least one stopper and the at least one engagement member preventing the suspension assembly to move in the at least one of the predetermined directions.

20. The suspension limiter of claim 19, further comprising at least one arm adapted to be pivotally connected to the frame, the at least one arm including the at least one stopper, and when in operation, a rotation of the at least one arm selectively abuts the at least one engagement member to the at least one stopper.

* * * * *